US011151913B2

(12) United States Patent
Long

(10) Patent No.: US 11,151,913 B2
(45) Date of Patent: Oct. 19, 2021

(54) ARRAY SUBSTRATE, DISPLAY PANEL AND DISPLAY DEVICE

(71) Applicant: BOE Technology Group Co., Ltd., Beijing (CN)

(72) Inventor: Chunping Long, Beijing (CN)

(73) Assignee: BOE Technology Group Co., Ltd., Beijing (CN)

( * ) Notice: Subject to any disclaimer, the term of this patent is extended or adjusted under 35 U.S.C. 154(b) by 0 days.

(21) Appl. No.: 16/754,953

(22) PCT Filed: Sep. 9, 2019

(86) PCT No.: PCT/CN2019/104969
§ 371 (c)(1),
(2) Date: Apr. 9, 2020

(87) PCT Pub. No.: WO2020/103537
PCT Pub. Date: May 28, 2020

(65) Prior Publication Data

US 2021/0027678 A1 Jan. 28, 2021

(30) Foreign Application Priority Data

Nov. 22, 2018 (CN) ..... 201821935327.8

(51) Int. Cl.
*G09G 3/00* (2006.01)
*G09G 3/20* (2006.01)

(52) U.S. Cl.
CPC ..... *G09G 3/006* (2013.01); *G09G 3/20* (2013.01); *G09G 2300/0809* (2013.01);
(Continued)

(58) Field of Classification Search
CPC ..... G09G 3/006; G09G 2310/0297; G09G 2320/0295; G09G 2330/12
See application file for complete search history.

(56) References Cited

U.S. PATENT DOCUMENTS 9,653,041 B2 5/2017 Nakanishi et al.
2010/0066383 A1 3/2010 Chung et al.
(Continued)

FOREIGN PATENT DOCUMENTS

CN 101364022 A 2/2009
CN 106019672 A 10/2016
(Continued)

*Primary Examiner* — Gerald Johnson
(74) *Attorney, Agent, or Firm* — Arent Fox LLP; Michael Fainberg

(57) ABSTRACT

Some embodiments of the present disclosure provide an array substrate, a display panel and a display device. The array substrate includes a test circuit located in a non-display area, wherein the test circuit includes at least one stage of subcircuit, and the subcircuit includes at least one demux; except the first stage of subcircuit, the input ends of the demuxes in the subcircuit are connected with corresponding output ends of the demuxes in the previous stage of subcircuit; except the last stage of subcircuit, the output ends of the demuxes in the subcircuit are connected with corresponding input ends of the demuxes in the next stage of subcircuit; and the input end of the demux in the first stage of subcircuit is connected with a test terminal, and the output ends of the demuxes in the last stage of subcircuit are connected with signal lines in a display area.

14 Claims, 10 Drawing Sheets

(52) U.S. Cl.
CPC . *G09G 2310/0297* (2013.01); *G09G 2330/04* (2013.01); *G09G 2330/12* (2013.01)

(56) References Cited

U.S. PATENT DOCUMENTS

| | | | | |
|---|---|---|---|---|
| 2016/0071463 | A1* | 3/2016 | Takahashi | H01L 27/3262 345/76 |
| 2018/0284926 | A1* | 10/2018 | Kim | G06F 3/044 |
| 2018/0330653 | A1* | 11/2018 | Zhou | G02F 1/13452 |

FOREIGN PATENT DOCUMENTS

| | | | |
|---|---|---|---|
| CN | 107065336 | A | 8/2017 |
| CN | 206516324 | U | 9/2017 |
| CN | 209232376 | A | 8/2019 |

* cited by examiner

ARRAY SUBSTRATE, DISPLAY PANEL AND DISPLAY DEVICE

This application is a National Stage of International Application No. PCT/CN2019/104969, filed on Sep. 9, 2019, which claims the priority to Chinese patent application No. 201821935327.8, filed with the China National Intellectual Property Administration on Nov. 22, 2018 and entitled "Array Substrate, Display Panel and Display Device", the entire contents of which are hereby incorporated by reference.

FIELD

The present disclosure relates to the technical field of display, in particular to an array substrate, a display panel and a display device.

BACKGROUND

With the rapid development of display technologies, the requirement on the quality of a display panel becomes higher and higher, so it is particularly important to test the various performances of the display panel.

In the display panel, a test circuit is arranged in a non-display area of an array substrate, and the testing of the display panel is mainly carried out by providing a first data signal to odd-row data lines in the display panel and a second data signal to even-row data lines of the display panel, so long as it is ensured that the polarities of the data signals provided to the odd-row data lines and the even-row data lines are opposite.

SUMMARY

Some embodiments of the present disclosure provide an array substrate which is divided into a display area and a peripheral non-display area, wherein the array substrate includes:

a test circuit located in the non-display area; wherein the test circuit includes at least one stage of subcircuit;

the at least one stage of subcircuit comprises at least one demux; the at least one demux comprises an input end and a plurality of output ends, and the at least one demux is configured to provide signals of the input end to corresponding output ends under a control of a plurality of control lines; except a first stage of subcircuit, an input end of a demux in each stage of subcircuit is connected with a corresponding output end of a demux in a previous stage of subcircuit;

except a last stage of subcircuit, output ends of the demuxes in each stage of subcircuit are connected with a corresponding input end of a demux in a next stage of subcircuit; and an input end of a demux in the first stage of subcircuit is connected with a test terminal providing test signals, output ends of a demux in the last stage of subcircuit are connected with signal lines in the display area, and the control lines connected with all stages of subcircuits are connected with control terminals providing control signals.

Alternatively, in some embodiments of the present disclosure, a quantity of demux in a stage of subcircuit is same as a quantity of output end of a demux in a previous stage of subcircuit preceding the stage of subcircuit.

Alternatively, in some embodiments of the present disclosure, the test circuit includes: one stage of subcircuit; and the subcircuit comprises one demux, an input end of the demux in the subcircuit is connected with the test terminal, and output ends of the demux in the subcircuit are connected with the signal lines in the display area.

Alternatively, in some embodiments of the present disclosure, the test circuit includes two stages of subcircuits;

a first stage of subcircuit comprises one demux, and an input end of the multiplex in the first stage of subcircuit is connected with the test terminal; and a second stage of subcircuit comprises a plurality of demuxes, input ends of the demuxes in the second stage of sub circuit are connected with output ends of the demux in the first stage of subcircuit in a one-to-one correspondence manner, and output ends of the demuxes in the second stage of subcircuit are connected with the signal lines in the display area.

Alternatively, in some embodiments of the present disclosure, the test circuit includes three stages of subcircuits;

a first stage of subcircuit comprises one demux, and an input end of the multiplex in the first stage of subcircuit is connected with the test terminal;

a second stage of subcircuit comprises a plurality of demuxes, and input ends of the demuxes in the second stage of subcircuit are connected with output ends of the demux in the first stage of subcircuit in a one-to-one correspondence manner; and a third stage of subcircuit comprises a plurality of demuxes, input ends of the demuxes in the third stage of subcircuit are connected with output ends of the demuxes in the second stage of subcircuit in a one-to-one correspondence manner, and output ends of the demuxes in the third stage of subcircuit are connected with the signal lines in the display area.

Alternatively, in some embodiments of the present disclosure, the array substrate includes a plurality of test circuits; and the test circuits share the control lines.

Alternatively, in some embodiments of the present disclosure, the at least one demux comprises a plurality of first transistors; and gates of the first transistors are connected with corresponding control lines respectively, first electrodes of the first transistors are connected with the input end of the at least one demux, and second electrodes of the first transistors are connected with corresponding output ends of the demux respectively.

Alternatively, in some embodiments of the present disclosure, the first transistors are a double-gate transistors.

Alternatively, in some embodiments of the present disclosure, a first electrostatic discharge circuit is arranged between every two adjacent control lines; and an input end of the first electrostatic discharge circuit is connected with one of two adjacent control lines, and an output end of the first electrostatic discharge circuit is connected with other one of two adjacent control lines.

Alternatively, in some embodiments of the present disclosure, the first electrostatic discharge circuit includes a second transistor and a third transistor, wherein a gate of the second transistor, a first electrode of the second transistor and a second electrode of the third transistor are all connected with one of two adjacent control lines; and a second electrode of the second transistor, a gate of the third transistor and a first electrode of the third transistor are all connected with other one of two adjacent control lines.

Alternatively, in some embodiments of the present disclosure, except the last stage of subcircuit, the output ends of the subcircuits are provided with a second electrostatic discharge circuit; and an input end of the second electrostatic discharge circuit is connected with the output ends of the demuxes in the subcircuits, and an output end of the second electrostatic discharge circuit is connected with discharge lines.

Alternatively, in some embodiments of the present disclosure, the second electrostatic discharge circuit includes at least one discharge subcircuit, and discharge subcircuits are arranged in series or in parallel.

Alternatively, in some embodiments of the present disclosure, the at least one the discharge subcircuit includes a fourth transistor, a fifth transistor, a sixth transistor and a seventh transistor, wherein a gate of the fourth transistor and a first electrode of the fourth transistor are connected with output ends of demuxes in corresponding subcircuit, and a second electrode of the fourth transistor is connected with the discharge lines;

a gate of the fifth transistor and a first electrode of the fifth transistor are connected with the output ends of the demuxes in the corresponding subcircuit, and a second electrode of the fifth transistor is connected with the discharge lines;

a gate of the sixth transistor and a first electrode of the sixth transistor are connected with the discharge lines, and a second electrode of the sixth transistor is connected with the output ends of the demuxes in the corresponding subcircuit; and a gate of the seventh transistor and a first electrode of the seventh transistor are connected with the discharge lines, and a second electrode of the seventh transistor is connected with the output ends of the demuxes in the corresponding subcircuit.

Correspondingly, some embodiments of the present disclosure also provide a display panel, including any one of the above array substrates provided by some embodiments of the present disclosure; and the output ends of the demuxes in the last stage of subcircuit in the test circuit in the array substrate are connected with corresponding signal lines in the display panel.

Correspondingly, some embodiments of the present disclosure also provide a display device, including the above display panel provided by some embodiments of the present disclosure.

DETAILED DESCRIPTION OF THE EMBODIMENTS

In order to make the purpose, technical solution and advantages of the present disclosure clearer, the specific implementation of an array substrate, a display panel and a display device provided by some embodiments of the present disclosure will be described in detail below in conjunction with the accompanying drawings. It should be understood that the preferred embodiments described below are only used to illustrate and explain the present disclosure and are not used to limit the present disclosure. Besides, some embodiments in the present application and the features in some embodiments may be combined with each other without conflict.

Figure 1:
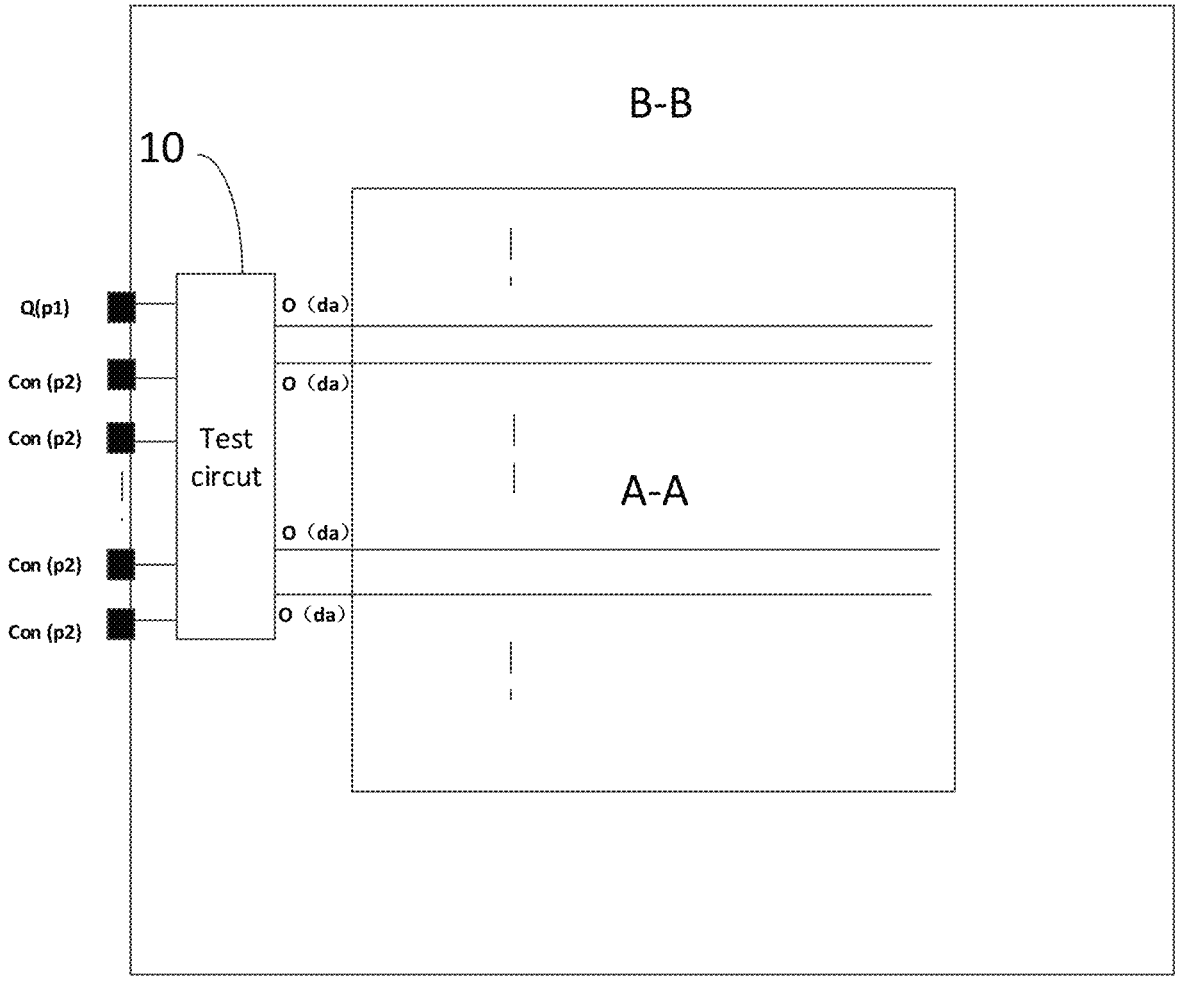
FIG. 1 is a structural schematic diagram of an array substrate provided by some embodiments of the present disclosure.
Figure 2:
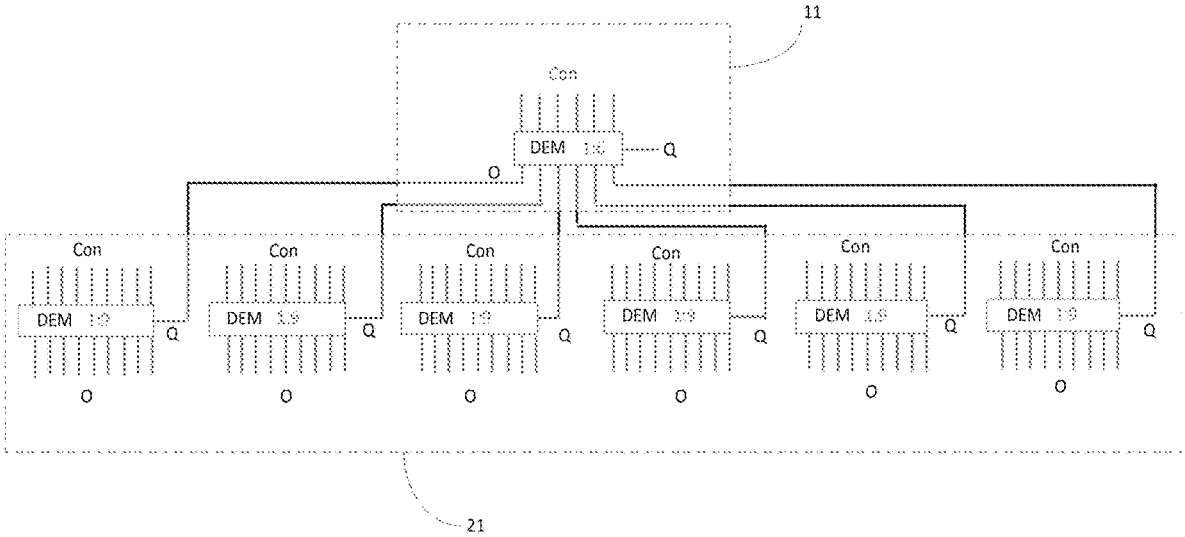
FIG. 2 is a structural schematic diagram of a test circuit provided by some embodiments of the present disclosure.

Some embodiments of the present disclosure provide an array substrate, as shown in FIG. 1 and FIG. 2, and the array substrate is divided into a display area A-A and a peripheral non-display area B-B, wherein the array substrate includes:

a test circuit 10 located in the non-display area B-B; wherein the test circuit 10 includes at least one stage of subcircuit (FIG. 2 is a schematic illustration of a test circuit including two stages of subcircuits);

each subcircuit includes at least one demux DEM; each demux DEM includes one input end Q and a plurality of output ends O, and each demux DEM is configured to provide signals of the input end Q to the corresponding output ends O under the control of a plurality of control lines Con;

except the first stage of subcircuit 11, the input ends Q of the demuxes DEM in each stage of subcircuit are connected with the corresponding output ends O of the demuxes DEM in the previous stage of subcircuit 11;

except the last stage of subcircuit 21, the output ends of the demuxes DEM in each stage of subcircuit are connected with the corresponding input ends Q of the demuxes DEM in the next stage of subcircuit; and the input end Q of the demux DEM in the first stage of subcircuit 11 is connected with a test terminal p1 providing test signals, the output ends of the demuxes DEM in the last stage of subcircuit 21 are connected with signal lines da in the display area, and the control lines Con connected with all stages of subcircuits are connected with control terminals p2 providing control signals.

Specifically, the array substrate provided by the present disclosure includes at least one stage of subcircuit; each subcircuit includes at least one demux, each demux includes one input end and a plurality of output ends, and each demux is configured to provide signals of the input end to the corresponding output ends under the control of a plurality of control lines; except the first stage of sub circuit, the input ends of the demuxes in each stage of subcircuit are connected with the corresponding output ends of the demuxes in the previous stage of subcircuit; except the last stage of subcircuit, the output ends of the demuxes in each stage of subcircuit are connected with the corresponding input ends of the demuxes in the next stage of subcircuit; and the input end of the demux in the first stage of subcircuit is connected with a test terminal providing test signals, the output ends of the demuxes in the last stage of subcircuit are connected with signal lines in the display area, and the control lines connected with all stages of subcircuits are connected with control terminals providing control signals. The above structure of the array substrate enables sub-pixels in each area of the display panel to be independently controlled, so that the display panel can display complex test pictures, which facilitates the detection of various defects of the display panel.

Alternatively, in the array substrate provided by some embodiments of the present disclosure, the number of the demuxes DEM in a certain stage of subcircuit 21 is the same as the number of the output ends O of the demuxes DEM in the previous stage of subcircuit 11. Therefore, the number of signal lines to which the test circuit can be connected is the largest.

Figure 3:
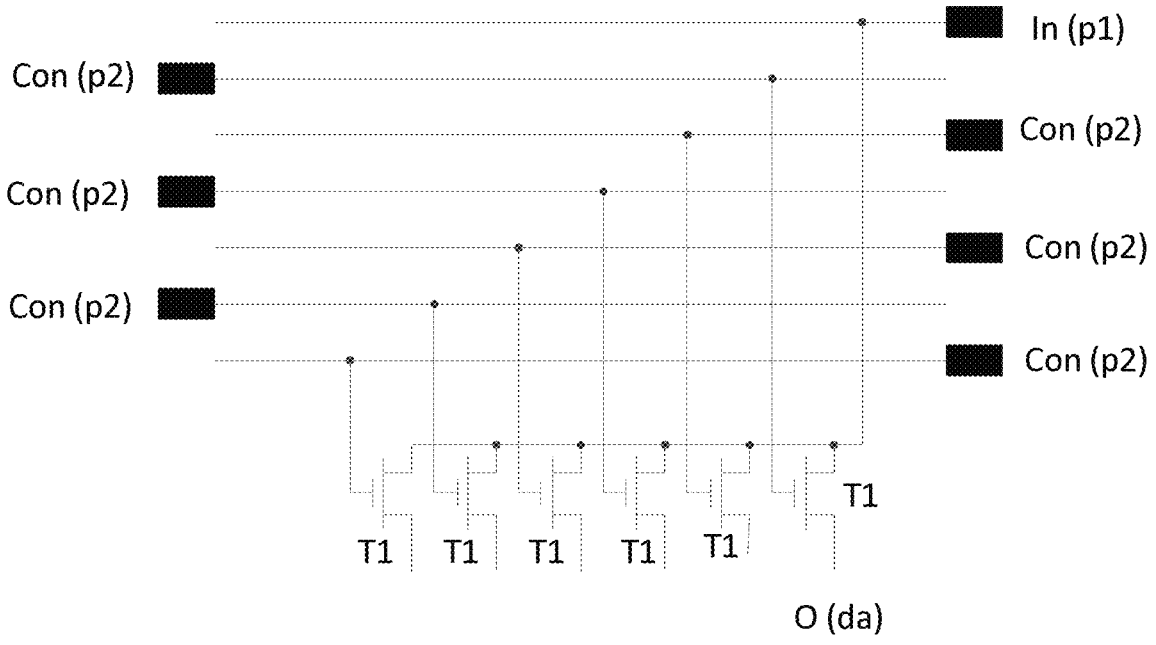
FIG. 3 is a detailed structural schematic diagram of the test circuit provided by some embodiments of the present disclosure.

Alternatively, in the array substrate provided by the present disclosure, as shown in FIG. 3, the test circuit includes: one stage of sub circuit; and the subcircuit includes one demux DEM, an input end Q of the demux DEM in the subcircuit is connected with the test terminal p1, and output ends O of the demux DEM in the subcircuit are connected with the signal lines da in the display area.

It should be noted that FIG. 3 is only a schematic illustration where the demux of the subcircuit includes six output ends, and the number of the output ends of the demux is set according to the number of signal lines to be measured, is not limited to the structure shown in FIG. 3, and is not specifically defined here.

Figure 4:
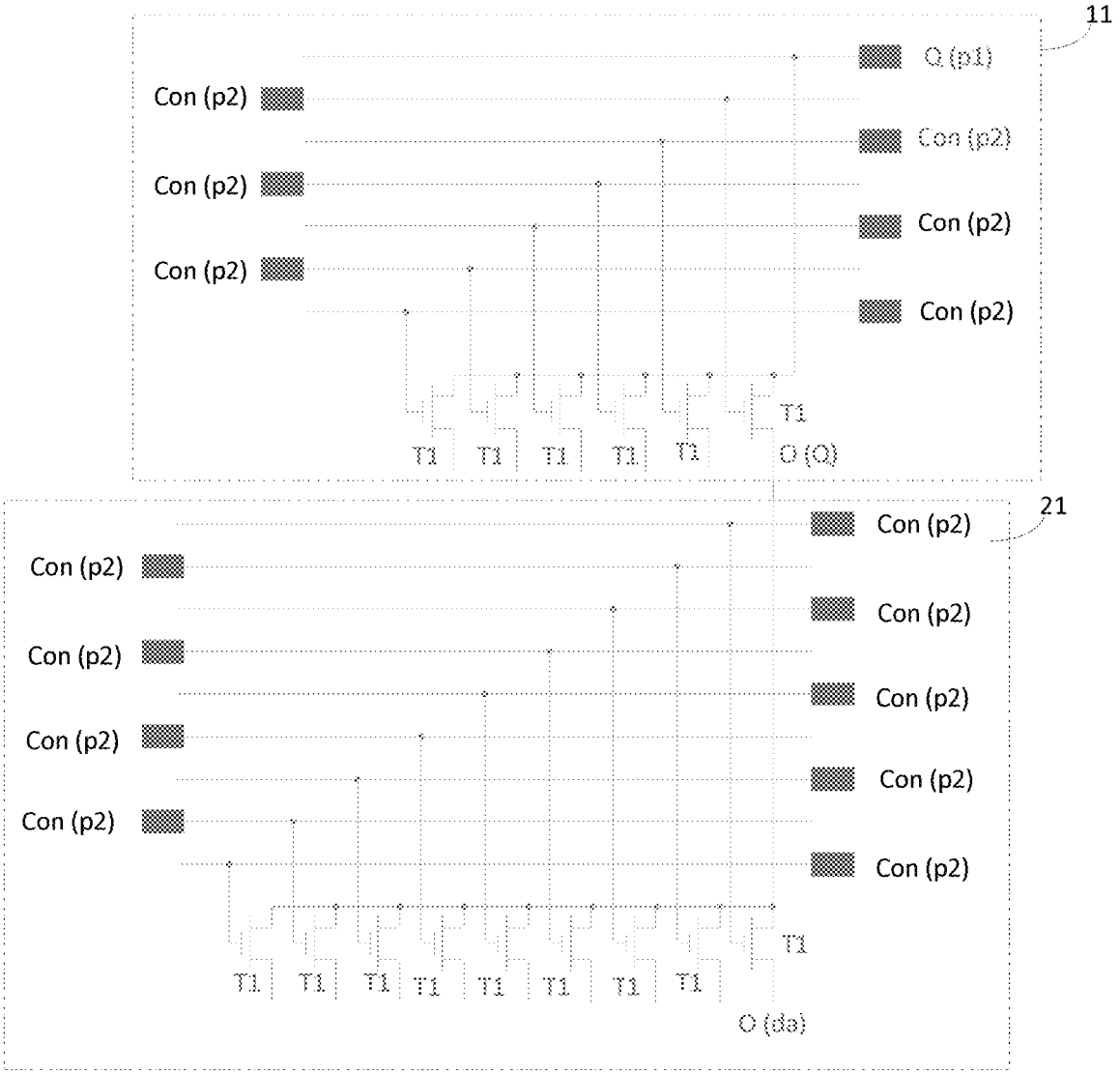
FIG. 4 is a detailed structural schematic diagram of another test circuit provided by some embodiments of the present disclosure.

Alternatively, in the array substrate provided by the present disclosure, as shown in FIG. 4, the test circuit includes: two stages of subcircuits, namely a first stage of subcircuit 11 and a second stage of subcircuit 21;

the first stage of sub circuit 11 includes one demux DEM, and an input end Q of the multiplex DEM in the first stage of subcircuit 11 is connected with the test terminal p1; and the second stage of subcircuit 21 includes a plurality of demuxes DEM, input ends Q of the demuxes DEM in the second stage of subcircuit 21 are connected with output ends O of the demux DEM in the first stage of sub circuit 11 in a one-to-one correspondence mode, and output ends O of the demuxes DEM in the second stage of subcircuit 21 are connected with the signal lines da in the display area.

It should be noted that FIG. 4 only shows the structure of one demux in the second stage of subcircuit, but the second stage of subcircuit includes six demuxes. Of course, the number of the demuxes in the second stage of sub circuit is not limited to six, and the demuxes need to be arranged corresponding to the output ends of the first stage of sub circuit, that is, it is guaranteed that the number of the demuxes in the second stage of subcircuit is the same as the number of the output ends of the demux in the first stage of subcircuit.

Figure 5:
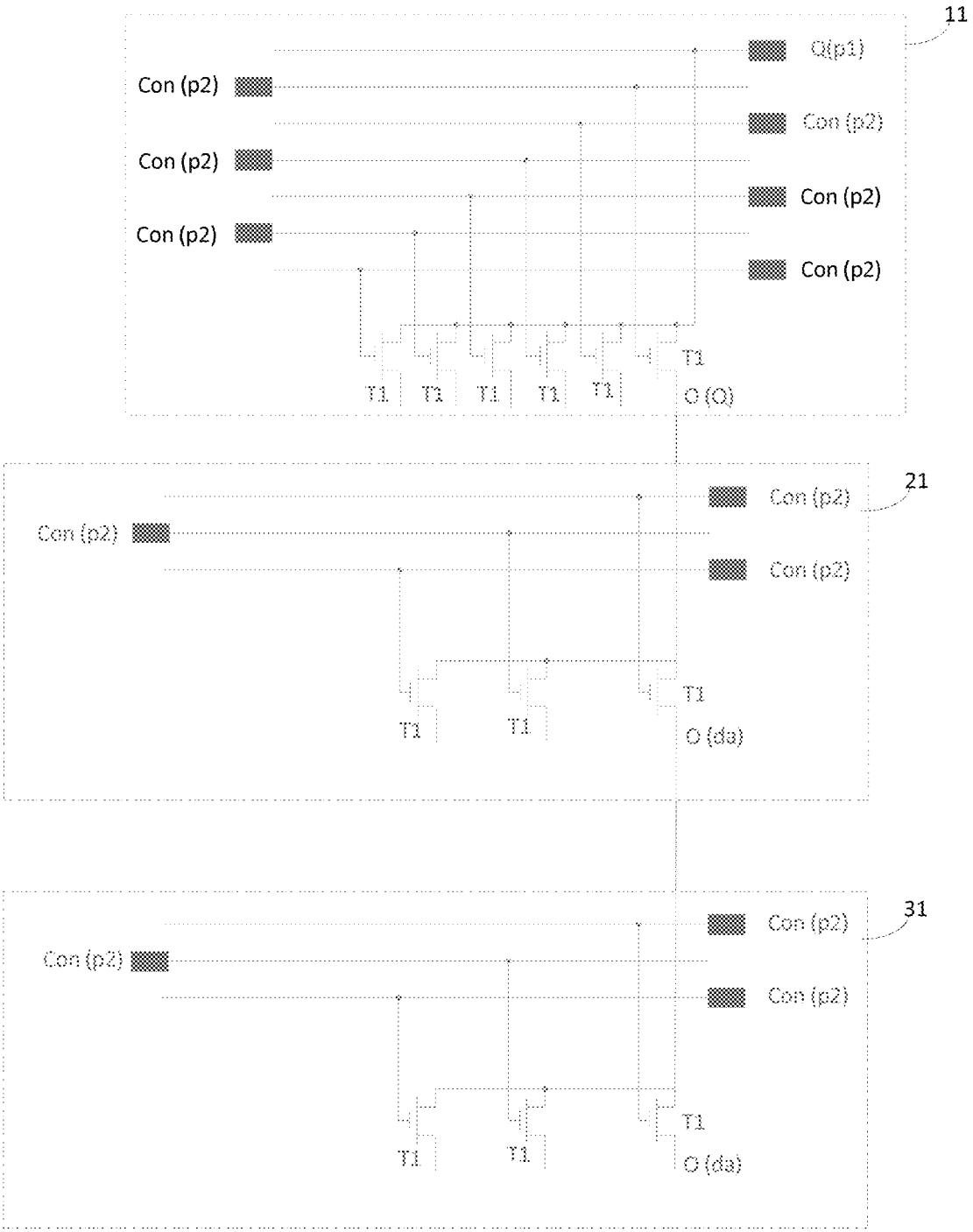
FIG. 5 is a detailed structural schematic diagram of another test circuit provided by some embodiments of the present disclosure.

Alternatively, in the array substrate provided by the present disclosure, as shown in FIG. 5, the test circuit includes: three stages of subcircuits, namely a first stage of subcircuit 11, a second stage of subcircuit 31 and a third stage of subcircuit 31;

the first stage of sub circuit 11 includes one demux DEM, and an input end Q of the multiplex DEM in the first stage of subcircuit 11 is connected with the test terminal p1;

the second stage of subcircuit 21 includes a plurality of demuxes DEM, and input ends Q of the demuxes DEM in the second stage of subcircuit 21 are connected with output ends O of the demux DEM in the first stage of subcircuit 11 in a one-to-one correspondence mode; and the third stage of subcircuit 31 includes a plurality of demuxes DEM, input ends Q of the demuxes DEM in the third stage of subcircuit 31 are connected with output ends O of the demuxes DEM in the second stage of subcircuit 21 in a one-to-one correspondence mode, and output ends O of the demuxes DEM in the third stage of subcircuit 31 are connected with the signal lines da in the display area.

It should be noted that in FIG. 5, the demux in the first stage of subcircuit has six output ends, each demux in the second stage of subcircuit has three output ends, and each demux in the third stage of subcircuit has three output ends, but the numbers of the output ends are not limited to these, and other proportions are possible depending on the number of signal lines to be tested. Moreover, in FIG. 5, only one demux is shown for each stage of subcircuit, while other demuxes are not shown.

Specifically, in the array substrate provided by the present disclosure, the test circuit structure shown in FIG. 2 is specifically described, wherein the demux DEM in the first stage of subcircuit 11 has six selection paths and each demux DEM in the second stage of subcircuit 21 has nine selection paths. The first stage of subcircuit 11 has six selection paths, that is, the first stage of subcircuit 11 has one input end Q, six control lines Con and six output ends O; the number of the demuxes DEM in the second stage of subcircuit 21 is the same as the number of the output ends O of the first stage of subcircuit 11, that is, the second stage of subcircuit 21 has six demuxes DEM, each of which has one input end (corresponding to the output end of the first stage of subcircuit), nine control lines, and nine output ends; in this way, the second stage of subcircuit 21 has 54 output ends, that is, test signals can be provided to 54 signal lines in the display area by being input through one input end of the first stage of subcircuit 11, and different signals can be provided to 54 signal lines according to the timing change of the test signals provided by the input end Q of the first stage of subcircuit 11, so that the display panel displays complex test pictures, and various performances of the display panel can be tested. For example, if the display panel has 1080 data lines, 20 groups of the structure as shown in FIG. 1 can be arranged to control the 1080 data lines in the display panel. If there are more data lines, more groups of the above structure can be arranged and bound in different areas of the display panel (wherein the test circuit is bound with signal lines in the display panel through a plurality of contact terminals pad). Of course, the number of stages of subcircuits in the test circuit and the number of the output ends of each demux in each stage of subcircuit can be set according to the requirements of specific implementation, and are not limited to the structure in the drawings, and the specific numbers are not specifically limited here.

Alternatively, in the array substrate provided by the present disclosure, the array substrate includes a plurality of test circuits; and the test circuits share the control lines.

Specifically, in the array substrate provided by the present disclosure, when a plurality of signal lines in the array substrate need to be tested, a plurality of the test circuits in the above embodiments can be provided in the non-display area of the array substrate, wherein various test circuits can share the control lines, thereby reducing wiring.

Alternatively, in the array substrate provided by the present disclosure, as shown in FIGS. 3-5, each demux includes a plurality of first transistors T1; and gates of the first transistors T1 are connected with the corresponding control lines Con respectively, first electrodes of the first transistors T1 are connected with the input end Q of the demux, and second electrodes of the first transistors T1 are connected with the corresponding output ends O of the demux respectively.

It should be noted that, as shown in FIGS. 3-5, except the first stage of subcircuit, the demux DEM in each stage of subcircuit is only part of the subcircuit, as each stage of sub circuit also includes a plurality of demuxes DEM corresponding to the output ends of the demuxes in the previous stage of subcircuit (other demuxes are not specifically shown in the figures).

Specifically, in the array substrate provided by some embodiments of the present disclosure, each first transistor is controlled by one control line, and control signals are provided to the gates of the first transistors according to test pictures to be displayed on the display panel, so as to control on or off of the first transistors; in each stage of subcircuit, the first electrodes of all the first transistors are connected with the same input end, that is, receive test signals provided by the same test signal line, even so, the timing of the test signals provided by the test signal line can be designed, so that different signals can be provided to corresponding signal lines, and complex test pictures can be displayed; and except that the second electrodes of the first transistors in the last stage of sub circuit are connected to the corresponding signal lines in the display area, the second electrodes of the first transistors in each other stage of subcircuit are connected to the corresponding input ends of the next stage of subcircuit.

Alternatively, in the array substrate provided by the present disclosure, each first transistor is a double-gate transistor.

Specifically, in the array substrate provided by some embodiments of the present disclosure, by adopting double-gate transistors as the first transistors, leakage current of the first transistors can be reduced, so as to reduce energy consumption and improve the stability of signal transmission.

Figure 6:
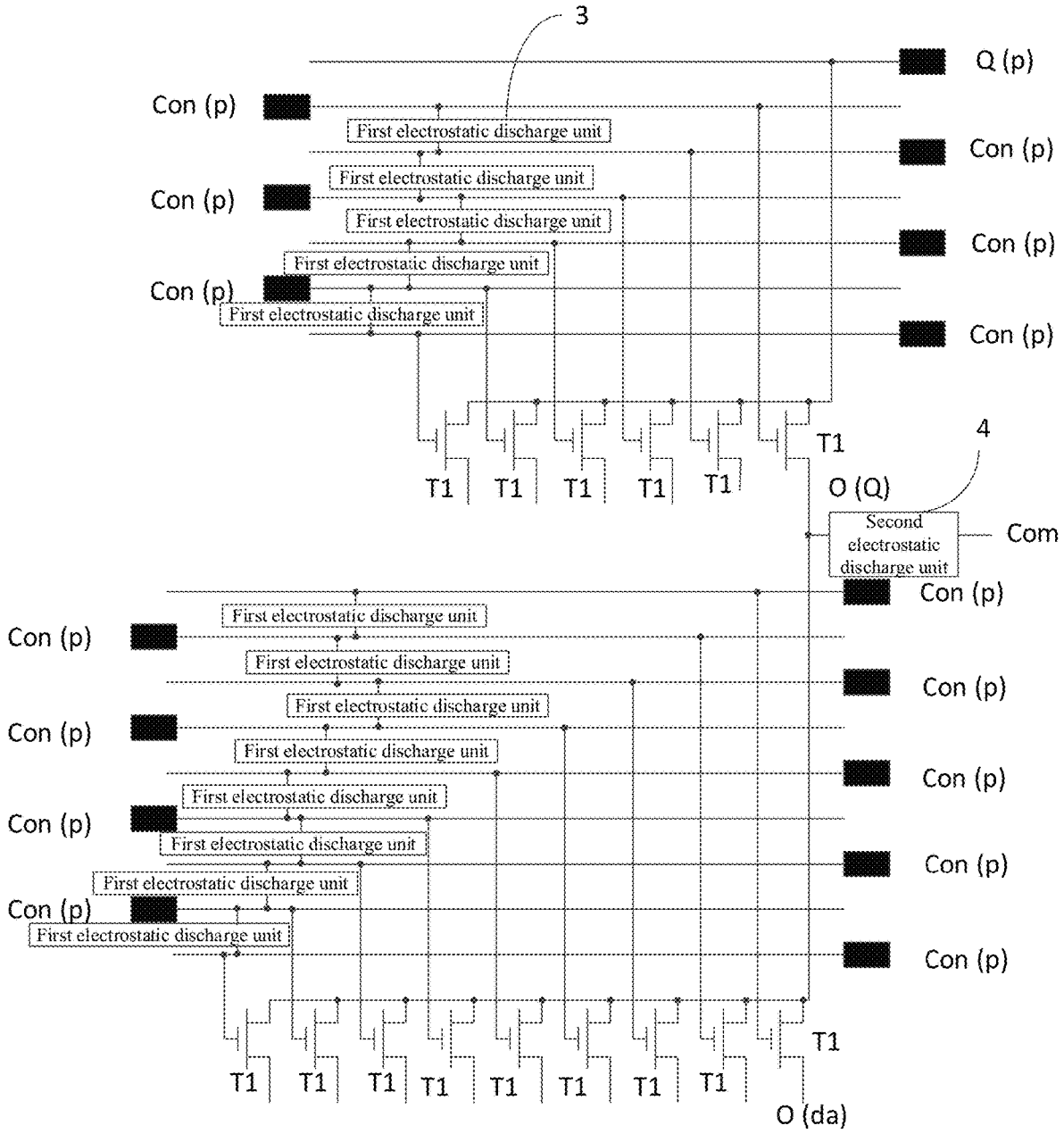
FIG. 6 is a detailed structural schematic diagram of another test circuit provided by some embodiments of the present disclosure.

Alternatively, in the array substrate provided by the present disclosure, as shown in FIG. 6, first electrostatic discharge circuits 3 are arranged between every two adjacent control lines Con; and an input end of each first electrostatic discharge circuit 3 is connected with one control line Con, and an output end of each first electrostatic discharge circuit 3 is connected with another adjacent control line Con.

Specifically, in the array substrate provided by some embodiments of the present disclosure, static electricity existing on various control lines can be evacuated by the first electrostatic discharge circuits, so that the influence of accumulation of static electricity on signals on the control lines can be avoided. Any structure capable of realizing static electricity transmission is within the protection scope of the present disclosure and is not specifically limited herein.

Figure 7:
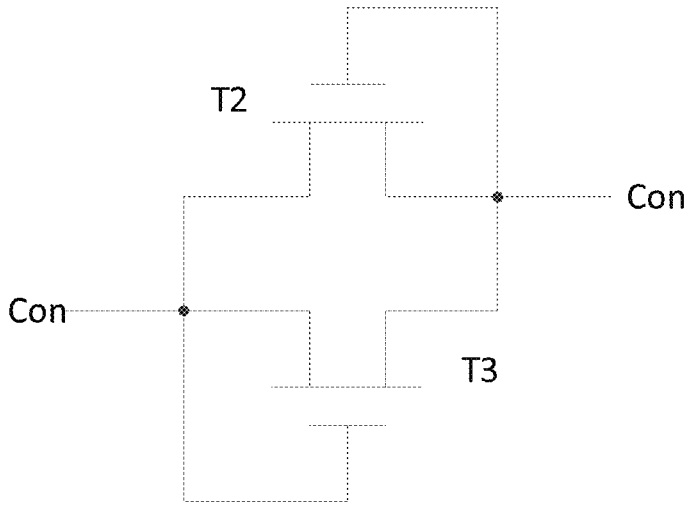
FIG. 7 is a detailed structural schematic diagram of a first electrostatic discharge circuit provided by some embodiments of the present disclosure.

Alternatively, in the array substrate provided by the present disclosure, as shown in FIG. 7, each first electrostatic discharge circuit includes a second transistor T2 and a third transistor T3, wherein a gate of the second transistor T2, a first electrode of the second transistor T2 and a second electrode of the third transistor T3 are all connected with one control line Con; and a second electrode of the second transistor T2, a gate of the third transistor T3 and a first electrode of the third transistor T3 are all connected with another control line Con.

Specifically, in the array substrate provided by some embodiments of the present disclosure, when accumulation of static electricity occurs on one control line, the voltages of the gate and the first electrode of the corresponding second transistor are increased, the second transistor is turned on, and the accumulated static electricity is transmitted to another control line to realize evacuation of static electricity; and when accumulation of static electricity occurs on another control line, the voltages of the gate and the first electrode of the corresponding third transistor are increased, the third transistor is turned on, and the accumulated static electricity is transmitted to the adjacent control line to realize evacuation of static electricity.

Alternatively, in the array substrate provided by the present disclosure, as shown in FIG. 6, except the last stage of subcircuit, the output ends O of the subcircuits are provided with second electrostatic discharge circuits 4; and input ends of the second electrostatic discharge circuits 4 are connected with the output ends O of the demuxes in the subcircuits, and output ends of the second electrostatic discharge circuits are connected with discharge lines Com.

Specifically, in the array substrate provided by the present disclosure, when accumulation of static electricity occurs on the output ends of the subcircuits, the second electrostatic discharge circuits supply static electricity at the output ends to the discharge line to realize electrostatic discharge.

Alternatively, in the array substrate provided by the present disclosure, each second electrostatic discharge circuit includes at least one discharge subcircuit, and the discharge subcircuits are arranged in series or in parallel.

Figure 8:
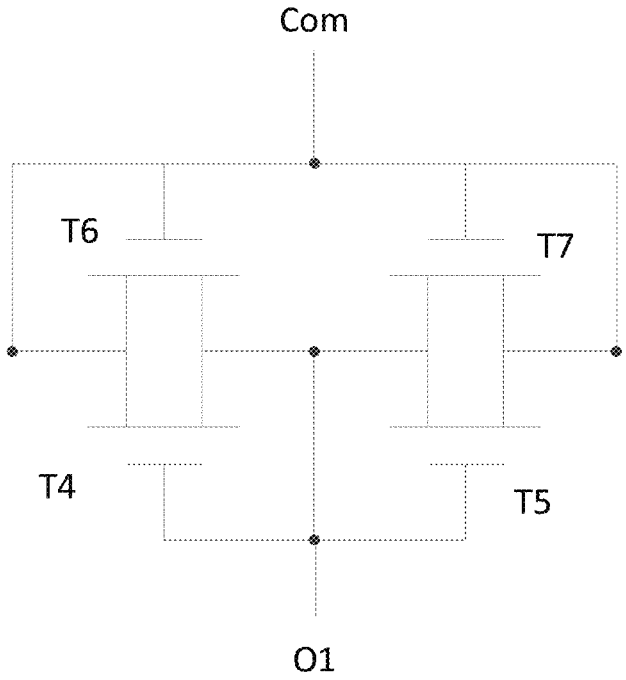
FIG. 8 is a detailed structural schematic diagram of a first electrostatic discharge circuit provided by some embodiments of the present disclosure.

Alternatively, in the array substrate provided by the present disclosure, as shown in FIG. 8, each of the discharge subcircuits includes a fourth transistor T4, a fifth transistor T5, a sixth transistor T6 and a seventh transistor T7, wherein a gate of the fourth transistor T4 and a first electrode of the fourth transistor T4 are both connected with the output ends O1 of the demuxes in the corresponding subcircuit, and a second electrode of the fourth transistor T4 is connected with the discharge line Com;

a gate of the fifth transistor T5 and a first electrode of the fifth transistor T5 are both connected with the output ends O1 of the demuxes in the corresponding subcircuit, and a second electrode of the fifth transistor is connected with the discharge line Com;

a gate of the sixth transistor T6 and a first electrode of the sixth transistor T6 are both connected with the discharge line Com, and a second electrode of the sixth transistor T6 is connected with the output ends O1 of the demuxes in the corresponding subcircuit; and a gate of the seventh transistor T7 and a first electrode of the seventh transistor T7 are both connected with the discharge line Com, and a second electrode of the seventh transistor T7 is connected with the output ends O1 of the demuxes in the corresponding subcircuit.

Figure 9:
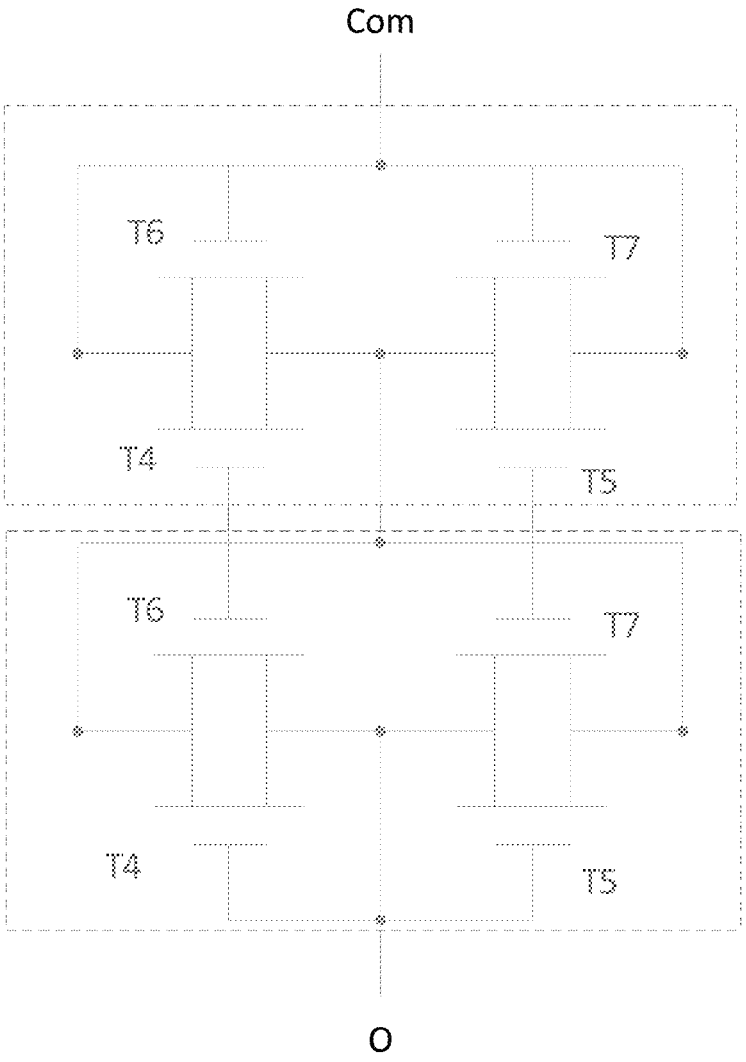
FIG. 9 is a detailed structural schematic diagram of another first electrostatic discharge circuit provided by some embodiments of the present disclosure.
Figure 10:
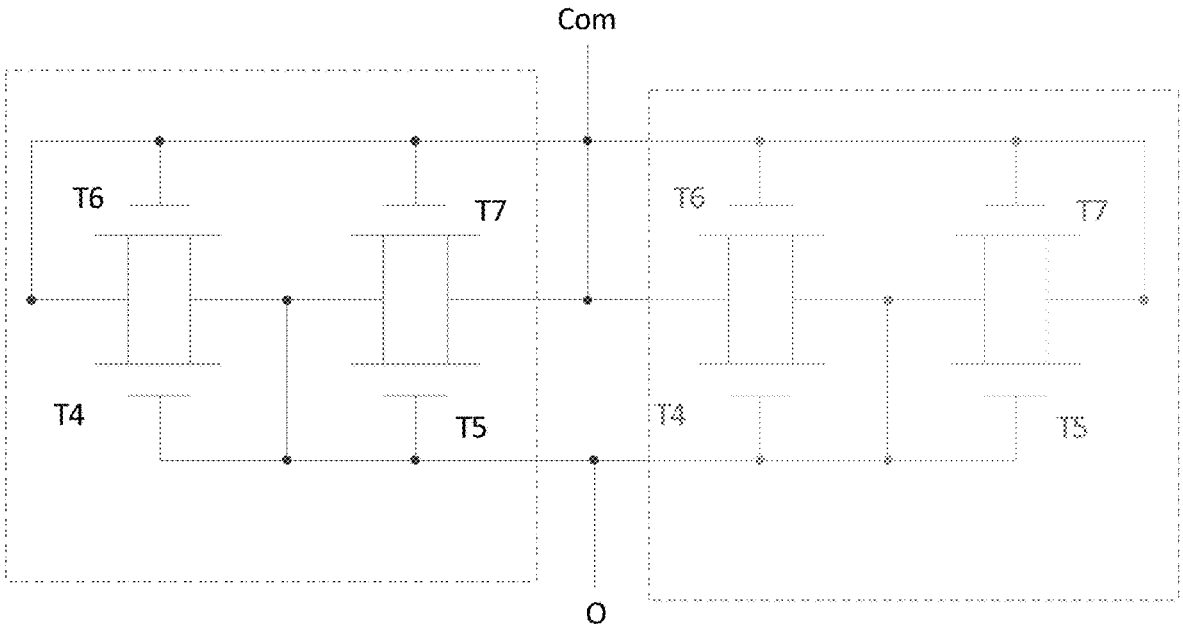
FIG. 10 is a detailed structural schematic diagram of another first electrostatic discharge circuit provided by some embodiments of the present disclosure.

It should be noted that when transistors in each second electrostatic discharge circuit are polysilicon transistors, two discharge subcircuits need to be arranged, input ends of the two discharge subcircuits are connected with the corresponding output end of the corresponding subcircuit, an output end of one discharge subcircuit is connected with one discharge line, and an output end of the other discharge subcircuit is connected with another discharge line, wherein the potentials of the two discharge lines are opposite; and when transistors in each second electrostatic discharge circuit are monocrystalline silicon transistors, only one discharge subcircuit needs to be arranged, an input end of the discharge subcircuit is connected with the corresponding output end of the corresponding subcircuit, an output end of the discharge subcircuit is connected with a discharge line, and the discharge line is generally connected with low voltage or grounded. The structure of the discharge subcircuit is not limited to the structure shown in FIG. 8, but may also be discharge structures as shown in FIG. 9 (a plurality of structures shown in FIG. 8 connected in series) and FIG. 10 (a plurality of structures shown in FIG. 8 connected in parallel). Of course, it may also be any other structure capable of realizing a discharge function, which is not specifically limited here.

The transistor mentioned in the above embodiment of the present disclosure may be a thin film transistor (TFT) or a metal oxide semiconductor field-effect transistor (MOS), which is not limited here. In specific implementation, a control electrode of each transistor serves as its gate, and the first electrode can serve as a source and the second electrode can serve as a drain, or the first electrode serves as the drain and the second electrode serves as the source according to the transistor type and input signals, which is not specifically limited here.

Based on the same inventive concept, some embodiments of the present disclosure also provide a display panel, which includes any one of array substrates provided in the above embodiments; and the output ends of the demuxes in the last stage of subcircuit in each test circuit in the array substrate are connected with the corresponding signal lines in the display panel.

The implementation and principle of the display panel are the same as the implementation and principle of the array substrate in the above embodiments, so the specific implementation of the display panel can be performed with reference to the specific implementation of the array substrate in the above embodiments and will not be repeated here.

Based on the same inventive concept, some embodiments of the present disclosure also provide a display device, including the display panel provided by the above embodiment.

The display device may be any product or component with a display function such as a mobile phone, a tablet computer, a television, a display, a notebook computer, a digital photo frame and a navigator. For the implementation of the display device, please refer to the above embodiment of the gate drive circuit, which will not be repeated here.

According to the array substrate, the display panel and the display device provided by some embodiments of the present disclosure, the array substrate includes at least one stage of subcircuit; each subcircuit includes at least one demux; each demux includes one input end and a plurality of output ends, and each demux is configured to provide signals of the input end to the corresponding output ends under the control of a plurality of control lines; except the first stage of subcircuit, the input ends of the demuxes in each stage of subcircuit are connected with the corresponding output ends of the demuxes in the previous stage of subcircuit; except the last stage of subcircuit, the output ends of the demuxes in each stage of subcircuit are connected with the corresponding input ends of the demuxes in the next stage of sub circuit; and the input end of the demux in the first stage of subcircuit is connected with a test terminal providing test signals, the output ends of the demuxes in the last stage of sub circuit are connected with signal lines in the display area, and the control lines connected with all stages of subcircuits are connected with control terminals providing control signals. The above structure of the array substrate enables sub-pixels in each area of the display panel to be independently controlled, so that the display panel can display complex test pictures, which facilitates the detection of various defects of the display panel.

Obviously, those skilled in the art can make various changes and modifications to the present disclosure without departing from the spirit and scope of the present disclosure. Thus, the present disclosure is also intended to include such modifications and variations if they fall within the scope of the claims of the present disclosure and their equivalents.

The invention claimed is:

1. An array substrate being divided into a display area and a peripheral non-display area, wherein the array substrate comprises:

a test circuit located in the non-display area;

wherein the test circuit comprises at least one stage of subcircuit;

the at least one stage of subcircuit comprises at least one demux; the at least one demux comprises an input end and a plurality of output ends, and the at least one demux is configured to provide signals of the input end to corresponding output ends under a control of a plurality of control lines;

except a first stage of subcircuit, an input end of a demux in each stage of subcircuit is connected with a corresponding output end of a demux in a previous stage of subcircuit;

except a last stage of subcircuit, output ends of the demuxes in each stage of subcircuit are connected with a corresponding input end of a demux in a next stage of subcircuit; and an input end of a demux in the first stage of subcircuit is connected with a test terminal providing test signals, output ends of a demux in the last stage of subcircuit are connected with signal lines in the display area, and the control lines connected with all stages of subcircuits are connected with control terminals providing control signals;

wherein a quantity of demux in a stage of subcircuit is same as a quantity of output end of a demux in a previous stage of subcircuit preceding the stage of subcircuit.

2. The array substrate according to claim 1, wherein the test circuit comprises one stage of subcircuit; and the subcircuit comprises one demux, an input end of the demux in the subcircuit is connected with the test terminal, and output ends of the demux in the subcircuit are connected with the signal lines in the display area.

3. The array substrate according to claim 1, wherein the test circuit comprises two stages of subcircuits;

a first stage of subcircuit comprises one demux, and an input end of the multiplex in the first stage of subcircuit is connected with the test terminal; and a second stage of subcircuit comprises a plurality of demuxes, input ends of the demuxes in the second stage of subcircuit are connected with output ends of the demux in the first stage of subcircuit in a one-to-one correspondence manner, and output ends of the demuxes in the second stage of subcircuit are connected with the signal lines in the display area.

4. The array substrate according to claim 1, wherein the test circuit comprises three stages of subcircuits;

a first stage of subcircuit comprises one demux, and an input end of the multiplex in the first stage of subcircuit is connected with the test terminal;

a second stage of sub circuit comprises a plurality of demuxes, and input ends of the demuxes in the second stage of subcircuit are connected with output ends of the demux in the first stage of subcircuit in a one-to-one correspondence manner; and a third stage of subcircuit comprises a plurality of demuxes, input ends of the demuxes in the third stage of subcircuit are connected with output ends of the demuxes in the second stage of subcircuit in a one-to-one correspondence manner, and output ends of the demuxes in the third stage of sub circuit are connected with the signal lines in the display area.

5. The array substrate according to claim 1, comprises a plurality of the test circuits; and the test circuits share the control lines.

6. The array substrate according to claim 1, wherein the at least one demux comprises a plurality of first transistors; and gates of the first transistors are connected with corresponding control lines respectively, first electrodes of the first transistors are connected with the input end of the at least one demux, and second electrodes of the first transistors are connected with corresponding output ends of the demux respectively.

7. The array substrate according to claim 6, wherein the first transistors are a double-gate transistors.

8. The array substrate according to claim 1, wherein a first electrostatic discharge circuit is arranged between every two adjacent control lines; and an input end of the first electrostatic discharge circuit is connected with one of two adjacent control lines, and an output end of the first electrostatic discharge circuit is connected with other one of two adjacent control lines.

9. The array substrate according to claim 8, wherein the first electrostatic discharge circuit comprises a second transistor and a third transistor, wherein a gate of the second transistor, a first electrode of the second transistor and a second electrode of the third transistor are all connected with one of two adjacent control lines; and a second electrode of the second transistor, a gate of the third transistor and a first electrode of the third transistor are all connected with other one of two adjacent control lines.

10. The array substrate according to claim 1, wherein except the last stage of subcircuit, the output ends of the subcircuits are provided with a second electrostatic discharge circuit; and an input end of the second electrostatic discharge circuit is connected with the output ends of the demuxes in the subcircuits, and an output end of the second electrostatic discharge circuit is connected with discharge lines.

11. The array substrate according to claim 10, wherein the second electrostatic discharge circuit comprises at least one discharge subcircuit, and in response to that the second electrostatic discharge circuit comprises two or more discharge subcircuits, the discharge subcircuits are arranged in series or in parallel.

12. The array substrate according to claim 11, wherein the at least one discharge sub circuit comprises a fourth transistor, a fifth transistor, a sixth transistor and a seventh transistor, wherein a gate of the fourth transistor and a first electrode of the fourth transistor are connected with output ends of demuxes in corresponding subcircuit, and a second electrode of the fourth transistor is connected with the discharge lines;

a gate of the fifth transistor and a first electrode of the fifth transistor are connected with the output ends of the demuxes in the corresponding subcircuit, and a second electrode of the fifth transistor is connected with the discharge lines;

a gate of the sixth transistor and a first electrode of the sixth transistor are connected with the discharge lines, and a second electrode of the sixth transistor is connected with the output ends of the demuxes in the corresponding subcircuit; and a gate of the seventh transistor and a first electrode of the seventh transistor are connected with the discharge lines, and a second electrode of the seventh transistor is connected with the output ends of the demuxes in the corresponding subcircuit.

13. A display panel, comprising the array substrate according to claim 1, wherein the output ends of the demux in the last stage of subcircuit in the test circuit in the array substrate are connected with corresponding signal lines in the display panel.

14. A display device, comprising the display panel according to claim 13.

* * * * *